United States Patent [19]

Polite

[11] Patent Number: 4,725,253

[45] Date of Patent: Feb. 16, 1988

[54] INFANT SAFETY FLOTATION SEAT DEVICE

[76] Inventor: Emmett L. Polite, Rte. #13 Box 1001, Columbia, Mo. 65201

[21] Appl. No.: 922,393

[22] Filed: Oct. 23, 1986

[51] Int. Cl.[4] ..... B63C 9/08

[52] U.S. Cl. ..... 441/130; 441/89

[58] Field of Search ..... 441/16, 36, 40, 38, 441/80, 83, 87; 244/122 R, 122 A, 122 AG, 122 AH, 122 B, 137 P, 140, 141

[56] References Cited

U.S. PATENT DOCUMENTS

| | | | |
|---|---|---|---|
| 2,470,783 | 5/1949 | Mead | 441/16 |
| 2,702,680 | 2/1955 | Heinemann et al. | 244/140 |
| 2,806,667 | 9/1957 | Kugler | 244/141 |
| 3,648,954 | 3/1972 | Gaylord | 244/122 B |

*Primary Examiner*—Sherman D. Basinger
*Assistant Examiner*—Jesûs D. Sotelo
*Attorney, Agent, or Firm*—Shoemaker and Mattare, Ltd.

[57] ABSTRACT

A personal flotation device for protecting the life of an infant human has a support housing with a back rest, a seat portion, and side wings co-extensive with each. A protective hood is pivotally mounted from the upper portion of the backrest wings. A support stand having a ballast weight contained at the lower end thereof is pivotally mounted from the area joining the backrest and set portion of the device. This permits accurate adjustment for various sizes and weights of children with whom the device is designed to be used. Appropriate signalling and attention attracting apparatus is also incorporated with this device. Also, a shoulder harness, seat belt, crotch belt and adjusting buckles therefor are provided.

17 Claims, 4 Drawing Figures

INFANT SAFETY FLOTATION SEAT DEVICE

BACKGROUND OF THE INVENTION

1. Field of the Invention

This invention relates generally to personal flotation devices designed to protect and save the life of a human infant.

2. Description of the Prior Art

A common problem of known devices of conventional type is that they generally do not fully protect an infant in all aspects, and/or fail to provide all of the needed rescue and attention attracting apparatus so that the human being secured thereby can be saved.

Various flotation devices have been made for protecting infants; however, none of the known prior art devices offer all of the new and novel features of the present invention in combination.

SUMMARY OF THE INVENTION

An object of the present invention is to provide a protective seat device for protecting and saving the life of a small infant.

Another object of the present invention is to provide a seat device for protecting a human being which is constructed of material which is approved by Government authorities. This device is not intended as a novelty or toy.

A further object of this invention is to provide a personal flotation device having a ballast stand for maintaining the device in substantially the upright position whether resting on a firm surface or floating in water. Tapered wings on each side of the device provide maximum strength and protection for the human contained therewithin.

A still further object of the present invention is to provide a flotation device having appropriate restraining belts therewith for holding a human securely therewith, and also a plurality of rescue seeking devices, as well as attention attracting apparatus, associated therewith.

The present invention provides a number of new and novel features over conventional type safety and protective devices. The present invention is for a personal flotation device (PFD) which is designed to protect and secure the life of an infant human ranging from birth (approximately 6 lbs.) to approximately 50 lbs. It will provide partly surrounding and enclosing structure for the protection of an infant from impact and physical injuries in case an accident transmits the PFD into a body of water. The design is such that the seat will right itself if necessary and float the person in an upright and slightly reclined position. The seat is designed with the flotation in such density so the seat will always float in an upright position, thereby keeping the head and upper body above the water and the legs and feet above water to continue to protect the infant from physical injuries and/or attack from fish or other sea life.

Preferably, the device is constructed of reinforced expandable close cell foam with a soft liner insert such as UNIROYAL ENSOLITE. In addition, a rigid frame of ABS plastic, metal, or any other suitable material, may be provided to add further strength and rigidity to the device. In addition, the seat will preferably be provided with the following equipment: a five point attached safety seat belt with shoulder straps, crotch strap, and waist straps with adjustable slides and snap release buckles; an adjustable support leg located near the bottom of the seat area to permit the correct balancing and reclining position to be adjusted according to the weight and height of the infant/child; and a rescue ring or loop at the top back and center of the device to assist in pulling the device from the water or merely to lift same.

The device is designed to accept several "off-the-shelf" items whose purpose is to assist in locating the PFD if separated from water craft and to provide additional safety and protection to the human. The device preferably includes the following items: reflector mirrors with various reflecting surfaces in numerous directions or planes to reflect light rays for visual location, the mirrors or reflectors being located near the top and/or side wings of the seat; a strobe light and/or flashing lights located on the top and the back rest of the seat or at the highest point on the seat when in the floating position; smoke flares located in the posterior area and on the top of the seat to permit the exhaust of the smoke above and away from the human; light flares located on the exterior area and near the top of the device; a radio or signal transmitter installed with a remote or attached antenna, and being the type of transmission to satisfy range and operating conditions, the transmitter ranging from a beeper horn, whistle, or C.B. to an emergency position indicating radio beacon (EPIRB); a sonar transmitter installed in the ballast support leg that is located below water level; shark repellant located at the base contour of the seat or in the area floating below water level, which is released by a water activated device; water dyes located at the base contour of the seat or in the area floating below water level; a counter ballast located in the support leg which can include an extension to lower the ballast to lower the center of gravity, thereby increasing the stability of the device in rough water; a flotation ring located at the base of the seat and above the pivot point of the support leg and inflated with $CO_2$ gas, thereby increasing the stability of the seat in open rough water; a tape recorder/player and/or radio with waterproof speakers-microphone located in the side wings near the top or head area of the seat to play a pre-recorded tape C.B. message or to transmit so a search/rescue party can know that the human is still alive and/or to pick up environmental noises; and a protective head shield at the top or head area of the seat to screen out the elements of nature and protect the human from an injury type impact.

The various electrical and electronic devices listed preferably will have an energy source which is rechargeable and/or solar powered. Of course, optional power sources activated by $CO_2$ gases or other chemical reactions is envisioned. It is also envisioned that the PFD of the present invention could be adapted to a stroller frame structure so that same could be pushed on a wheel frame in addition to it being used as an automobile child seat. While the present invention is primarily designed for use with small humans and infants, it could be enlarged in size and buoyancy to accommodate a physically handicapped adult human.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
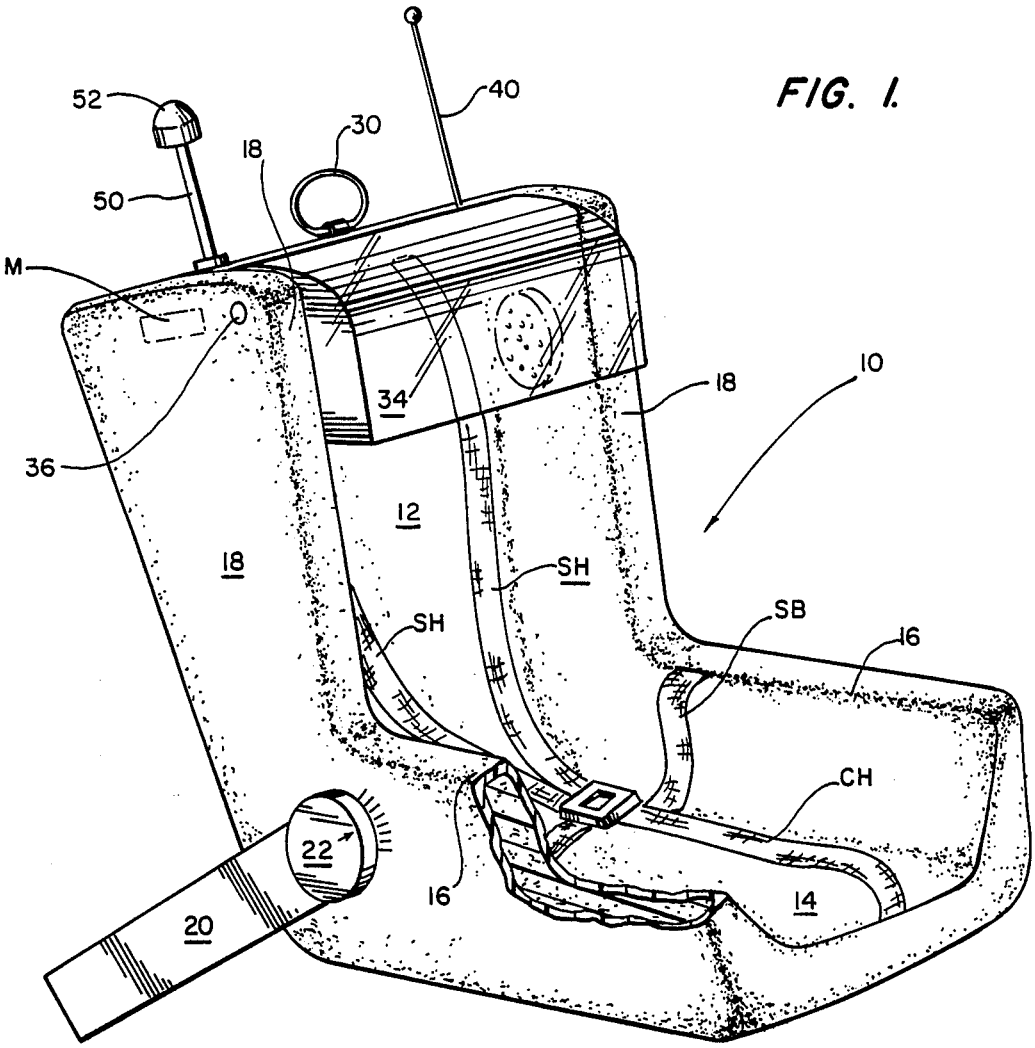
FIG. 1 is a perspective view of the present invention.
Figure 2:
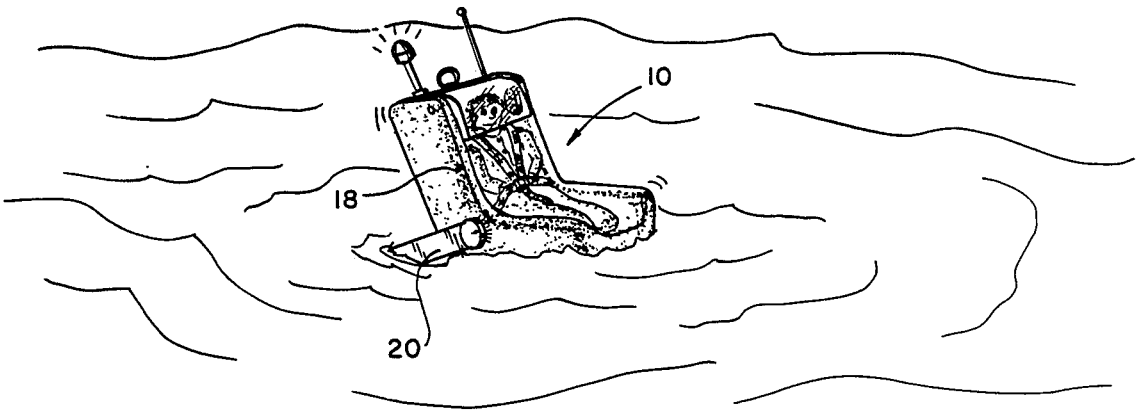
FIG. 2 is a perspective view of the device as in use floating in a body of water.
Figure 4:
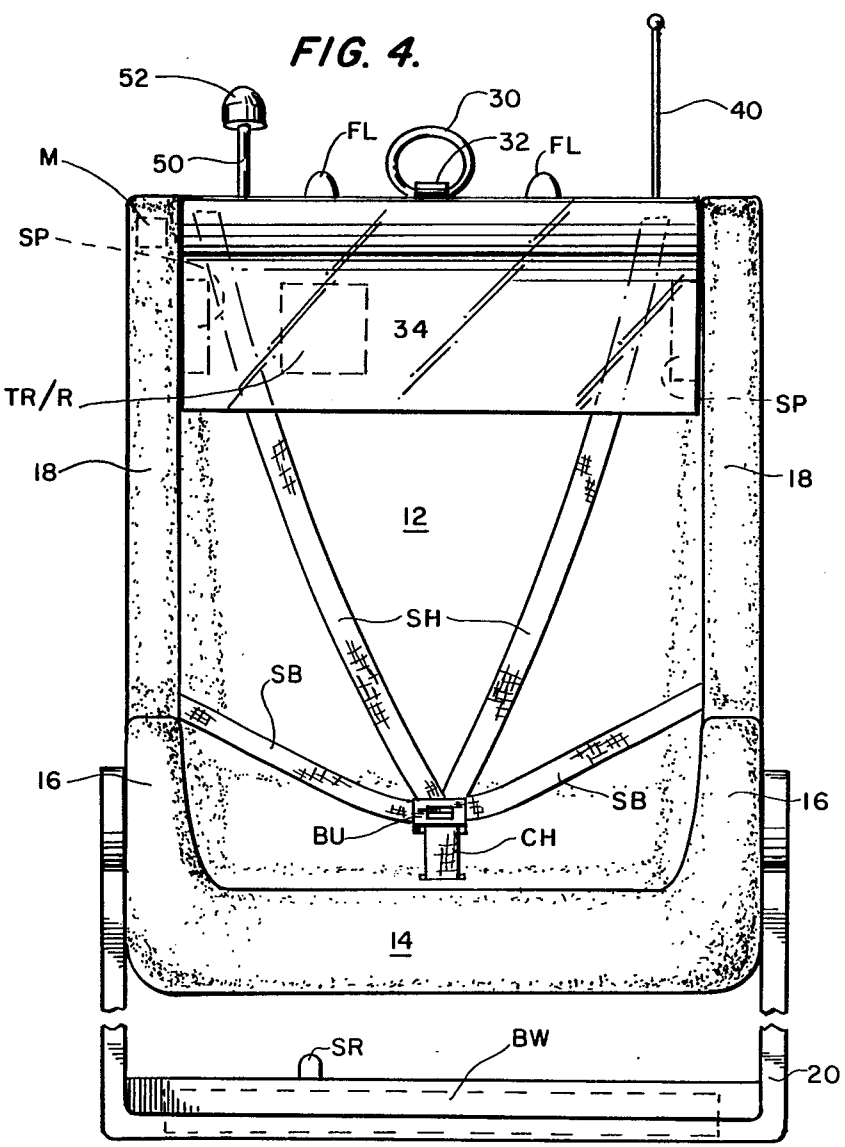
FIG. 4 is a front elevational view of the device.
Figure 3:
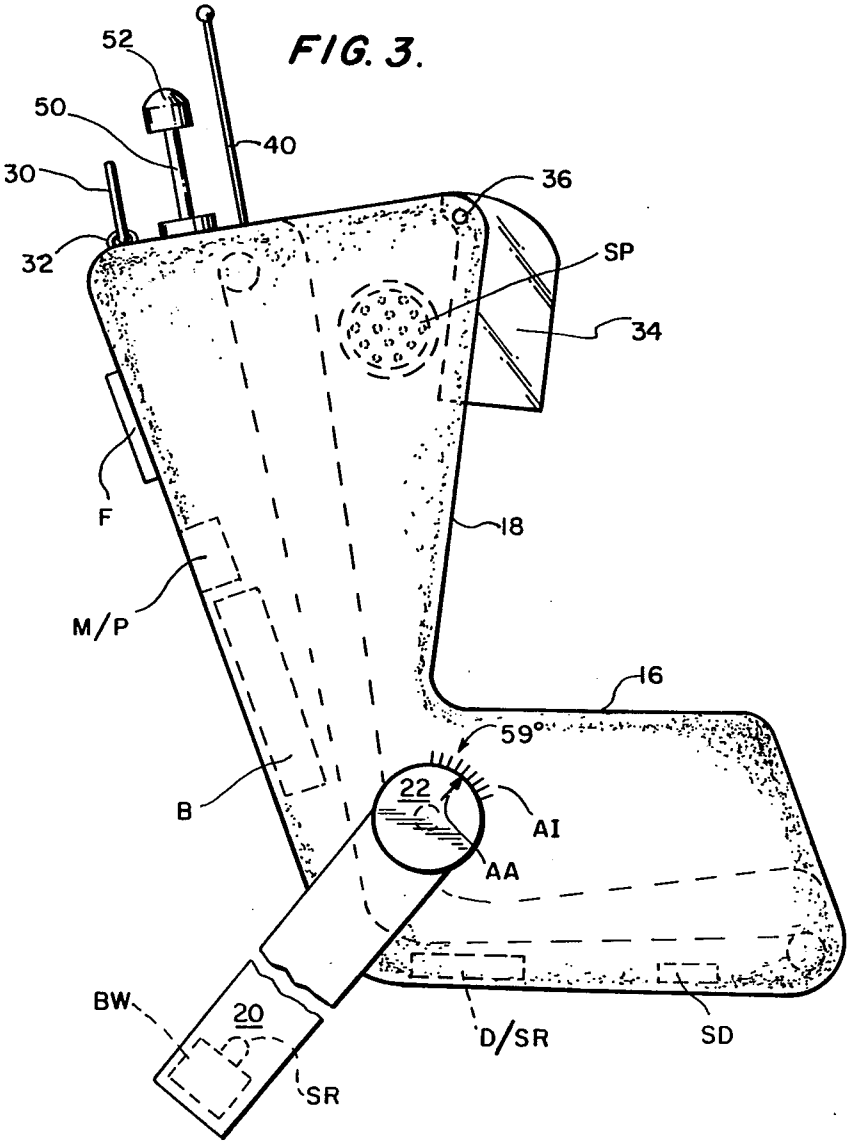
FIG. 3 is a side elevational view of the device per se.

Referring to FIGS. 1 and 2 of the drawings, reference numeral 10 indicates in general the present invention. The personal flotation device (PFD) has a shaped support housing including a back rest 12, a seat portion 14 and side wings 16 and 18. These side wings are contiguous and slightly sloped or tapered to join with the respective back rest and seat portions.

Preferably, this structure is made of cell flotation foam having a hard, rigid plastic outer shell. In addition, a hinge protective hood 34 is preferably pivotally mounted by pivot pins 36 from the respective upper and extending wing portions 18. A lifting and support ring 30 is also integral with the head portion of the back rest.

Another important element of subject invention is the pivotally mounted support and ballast stand 20. As shown, this element 20 has pivot mountings 22 at the respective ends thereof. Preferably, adjustment indicia in the form of a portion of a compass rose AI is provided on at least one side of the PFD for use with an alignment arrow AA on the pivot ends 22 of the stand, the purpose of this being that a predetermined line, such as the 59° one shown, can be used for general adjustment, and then various more precise adjustments can be made as needed for a particular infant or human with whom the device is to be used.

Preferably, for restraining and protecting the infant, seat belts SB are provided, together with appropriate buckle structure BU. A crotch harness CH also should be included, as well as shoulder harness straps SH.

Preferably, two waterproof speakers SP are mounted on both wings internally of the PFD. At least one speaker SP, however, should be provided. An appropriate receiver and/or transmitter/receiver TR/R also should be provided. An appropriate radio antenna 40 is shown.

In addition, a strobe light 52 mounted upon a stand 50 is intended to provide rescue attracting flashing light apparatus to the PFD. Also, flashing lights FL may be provided as well. Attention attracting mirrors M also may be added as appropriate to the upper portion of the PFD. Preferably, the ballast weight BW in the lower portion of the adjustable support stand 20 is adequate for maintaining the PFD in a substantially upright position. A sonar device SR also preferably is incorporated in the stand for emitting sonar signals while the device is floating in water. A battery compartment B also is included, as well as a dye and shark repellant apparatus D/SR.

Both the signal emitting apparatus, radio receiver and two-way radio/transmitter equipment will aid in search parties rescuing the occupant of the device. The reflecting mirrors, flashing lights and strobe light will all aid in finding the device. In addition, a smoke emitting flare, as well as a light emitting flare, may be appropriately mounted on the rear of the back rest for emitting smoke and light in addition to the already described attention attracting devices.

Also, the device is equipped with a water activated sensing device SD which will control and turn on the various afore-described apparatus. A monitor and program circuit M/P will also be included mounted upon the back rest structure. This will perform a time control function for the various other devices once turned on and activated by the water sensitive detector SD.

This personal restraint life seat is intended for protecting the life of an infant in case of an accident that could happen in or around water, or any other hazardous conditions. The life seat comes equipped with adjustable restraint belts or harnesses sized to maintain the person in the seat in case the child and seat are accidentally thrown into a body of water by the child, a force or means other than the child's actions, or other actions that cannot be controlled. The seat should be constructed of materials that meet or exceed the requirements of the Coast Guard, Department of Transportation or any other governing body which has the jurisdiction to control the safety of small children. This seat will conform to strict strength and protection standards and is made of structural material to meet safety and life protection standards for children. This seat is not intended to be used for recreation or as a novelty item, but solely for the purpose of a life support system or personal flotation device as required by law or that good judgement decrees. The basic chair is equipped with many types of signal-tracking and comfort items, either supplied by vendors of products already on the market or designed to be added to the seat, depending upon the area where the life support seat is used. Any and all added systems are to be controlled by a sensing device activated by water contact, life support line, or impact of a severe nature. The automatic sensing and triggering device would set in motion or operation a time controlled monitoring circuit that would program each item added to the seat to function on a pre-programmed schedule to permit efficient search and rescue of the child in the safety flotation seat.

The part of the seat called the ballast or seat is very important and functions to keep the seat from floating upside down. With the correct weight and angle setting for the height and weight of the child, it will act the same as a ballast on a sailboat. The center of flotation or gravity will prevent the seat from turning over or floating in any direction other than an upright position. A number of signal detection and prevention systems can be installed in the ballast and also programmed from the central pre-programmed center.

The child should be secured in the seat with the restraint harness. At that time all central systems should be set, before an emergency happens. The restraints are adjustable and are positioned to support the child in the safest position with regard to height and weight. The enclosed structure of the seat protects the body around and below the head from harm or injury, which protection is not provided by conventional life jackets.

Items which are incorporated in this seat are devices for emitting sonar sound waves of all types that can be tracked by appropriate tracking equipment, strobe lights, smoke flares, aerial flares, water dyes, horns, shark repellant, a flotation collar that is gas expandable, a protective hood or shield, a tape player, a radio and/or other communications equipment. All equipment can be operated by either a rechargeable, replaceable, or solar powered cell. Also, a microchip to reflect back signals may be added.

This life protection seat for the survival of human infants in dangerous conditions is needed, and it can also be used as a car seat.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective safety device for humans, comprising:
a support means for holding a person substantially protected therewithin;
adjustable stand means for maintaining said support means in a substantially upright position;
signalling means mounted on said support means; and
attention attracting means also mounted on said support means, said support means for holding a person substantially protected therewithin including a shaped support housing having a backrest, a seat portion, and side wings on each side of the aforesaid, said adjustable stand means including a support and ballast stand which is pivotally attached to said support means and further including a ballast weight at the unattached end thereof, and said pivotally mounted stand is provided with adjustment indicia adjacent the pivot mount for precision adjustment of said stand relative to said support means.

2. The protective safety device of claim 1, together with a seat belt and a shoulder harness affixed to said support means for restraining a person seated therewithin.

3. The protective safety device of claim 2, further including a crotch strap and a waist strap, together with adjustable slides and snap release buckles therefor.

4. The protective safety device of claim 1, wherein said adjustment indicia includes a portion of a compass rose indicia provided on said support means and an indicating arrow on said stand for alignment therewith.

5. The protective safety device of claim 1, wherein said signalling means mounted on said support means includes apparatus for emitting radiation signals from said device.

6. The protective safety device of claim 5, wherein said signal emitting apparatus comprises sonar apparatus.

7. The protective safety device of claim 5, wherein said signal radiating apparatus emits radio frequency beacon signals.

8. The protective safety device of claim 7, wherein said apparatus comprises a device for providing two-way radio frequency communication between a person contained in said device and a search party.

9. The protective safety device of claim 1, wherein said attention attracting means mounted on said support means includes a strobe light apparatus.

10. The protective safety device of claim 1, wherein said attention attracting means mounted on said support means includes flashing lights.

11. The protective safety device of claim 1, wherein said attention attracting means mounted on said support means includes a light flare.

12. The protective safety device of claim 1, wherein said attention attracting means mounted on said support means includes a smoke flare.

13. A protective safety device for humans, comprising:
a support means for holding a person substantially protected therewithin;
adjustable stand means for maintaining said support means in a substantially upright position;
signalling means mounted on said support means; and
attention attracting means also mounted on said support means, and said adjustable stand means is pivotally attached to said support means and further includes a ballast weight at the unattached end thereof, said pivotally mounted stand being provided with adjustment indicia adjacent the pivotal attachment for precision adjustment of said stand relative to said support means.

14. The protective safety device of claim 13, wherein said attention means includes apparatus for emitting light from the device.

15. The protective safety device of claim 14, wherein said signalling means mounted on said support means includes apparatus for emitting radiation signals from said device.

16. The protective safety device of claim 13, wherein said signalling means mounted on said support means includes apparatus for emitting radiation signals from said device.

17. The protective safety device of claim 16, together with apparatus for emitting light intermittently.

* * * * *